United States Patent [19]

Gleason

[11] 4,093,231

[45] June 6, 1978

[54] SUPERFLY GAME APPARATUS

[76] Inventor: John Gleason, 125-10 Queen Blvd., Kew Gardens, N.Y. 11415

[21] Appl. No.: 821,617

[22] Filed: Aug. 3, 1977

[51] Int. Cl.[2] ..... A63F 9/00

[52] U.S. Cl. ..... 273/108

[58] Field of Search ..... 273/1 R, 1 E, 1 M, 108, 273/119 R, 119 AB, 122 R, 122 A, 86 D

[56] References Cited

U.S. PATENT DOCUMENTS

| | | | |
|---|---|---|---|
| 1,853,900 | 4/1932 | Johnson | 273/108 |
| 2,443,354 | 6/1948 | Johnson | 273/86 D UX |
| 2,530,555 | 11/1950 | Tobin et al. | 273/108 X |

*Primary Examiner*—Paul E. Shapiro

*Attorney, Agent, or Firm*—Joel Halpern

[57] ABSTRACT

Superfly game apparatus includes a simulated building structure having four side walls and a roof. A scaffold is carried by each side wall and a simulated helicopter is rotatably carried by the roof. A set of playing pieces is provided each of which is configured to represent a human figure and each of which is positionable at various elevational levels along a corner of the simulated building structure. Each of the corners of the simulated building structure are given retaining elements cooperable with the playing pieces for retaining such pieces. The game apparatus also includes elements which are manually operable to impart vertical movement to the playing pieces to move the pieces upwardly along the corners of the structure.

10 Claims, 5 Drawing Figures

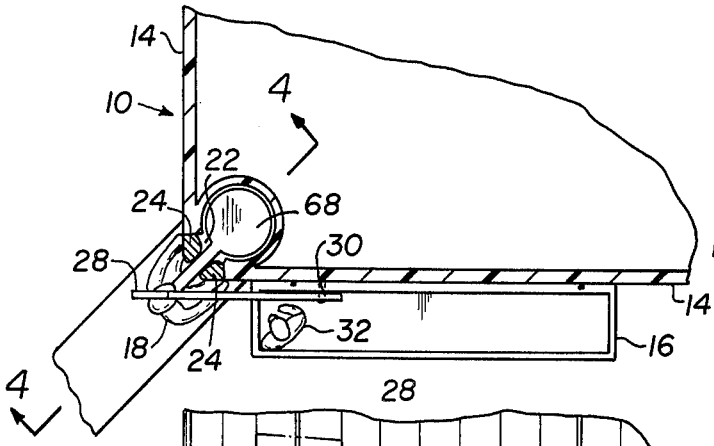
FIG.2
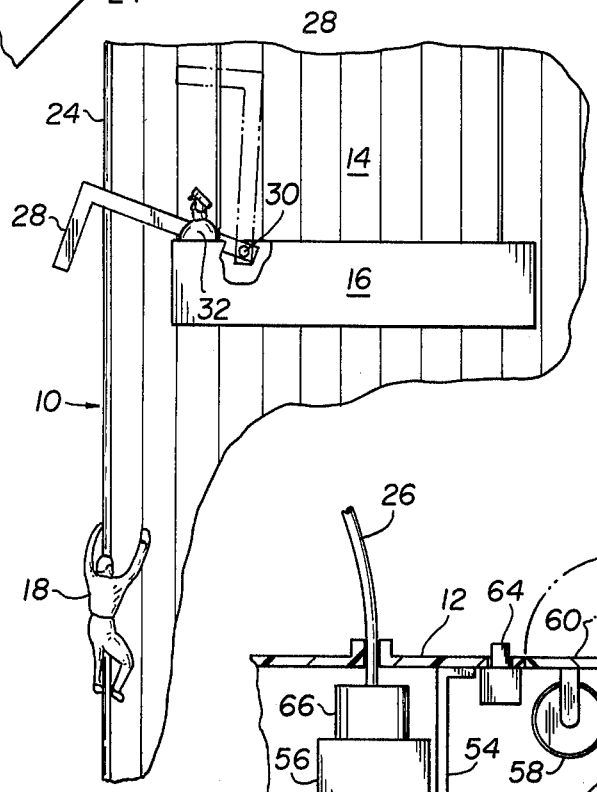
FIG.3
FIG.5
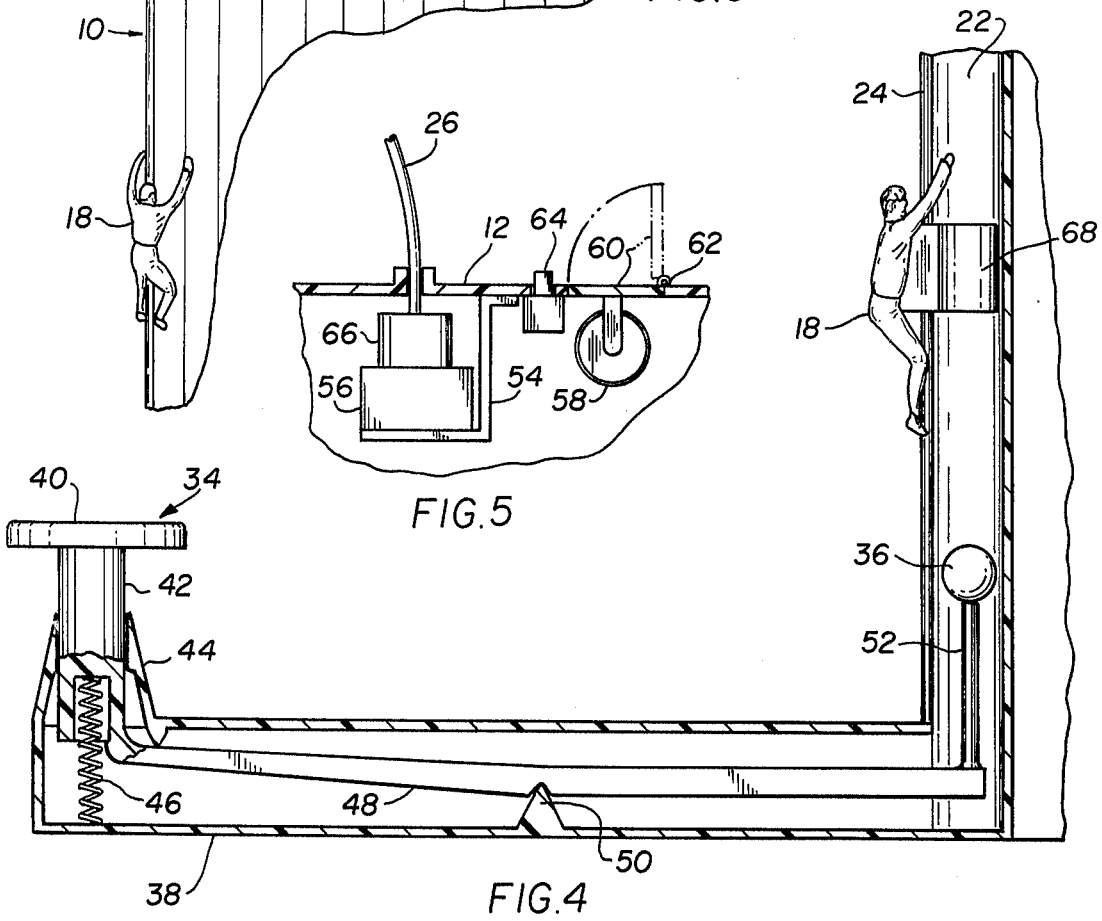
FIG.4

SUPERFLY GAME APPARATUS

BACKGROUND OF THE INVENTION

This invention pertains to game apparatus and more particularly to game apparatus intended to reproduce in an entertaining and challenging manner certain events which captured the imagination and attention of the public.

The exploits of the individual who scaled the World Trade Center building recently were heralded in the various media and catapulated such person to the forefront of the news. Among the appellations bestowed upon him was the designation "Superfly". Although it is beyond the physical and psychological capabilities of the average person to duplicate his feat in fact there remains a desire to associate ones self with the feat even if only through the medium of a game in an altogether myth-like and fanciful environment.

SUMMARY OF THE INVENTION

It is one object of the invention to provide game apparatus which reproduces the excitement and simulates the exploits of the individual who climbed one of the towers of the World Trade Center in New York City.

It is another object of the invention to provide game apparatus which enables players of various age groups to vicariously and in a competitive game to experience the emotions of one scaling a skyscraper.

It is yet another object of this invention to provide a game which, because of the controllable nature of the elements thereof, will be enjoyable to players of various age groups desirous of participating in a situation which creates a competitive environment.

Other objects and advantages of the invention will become readily apparent to persons versed in the field of toy and game design and manufacture from the ensuing description of the invention.

According to the invention there is provided a superfly game apparatus comprising a simulated building structure having side walls and a roof, a scaffold carried by each of the side walls, a simulated helicopter mounted rotatably on the roof for rotation about the structure, a series of playing pieces each configured to represent a human figure and adapted to be positioned at various elevational levels along corners of the structure, retaining means on the corners of the structure cooperable with the playing pieces so as to retain such pieces at selected elevational levels, and manually operable means for moving the playing pieces vertically along the corners of the structure.

BRIEF DESCRIPTION OF THE DRAWINGS

In order that the invention may be more fully comprehended it will now be described, by way of example, with reference to the accompanying drawings in which:

FIG. 2 is a sectional view of a corner of the structure shown in FIG. 1 taken along line 2—2 thereof;

FIG. 3 is an enlarged fragmentary view of a portion of the side wall and corner of the structure containing a scaffold;

FIG. 4 is an enlarged cross-sectional view in elevation of a lower corner of the structure and the member for imparting vertical movement to the playing piece; and FIG. 5 is a fragmentary cross-sectional view of a portion of the roof of the structure and the mounting of the helicopter taken along line 5—5 of FIG. 1.

DETAILED DESCRIPTION OF THE INVENTION

Figure 1:
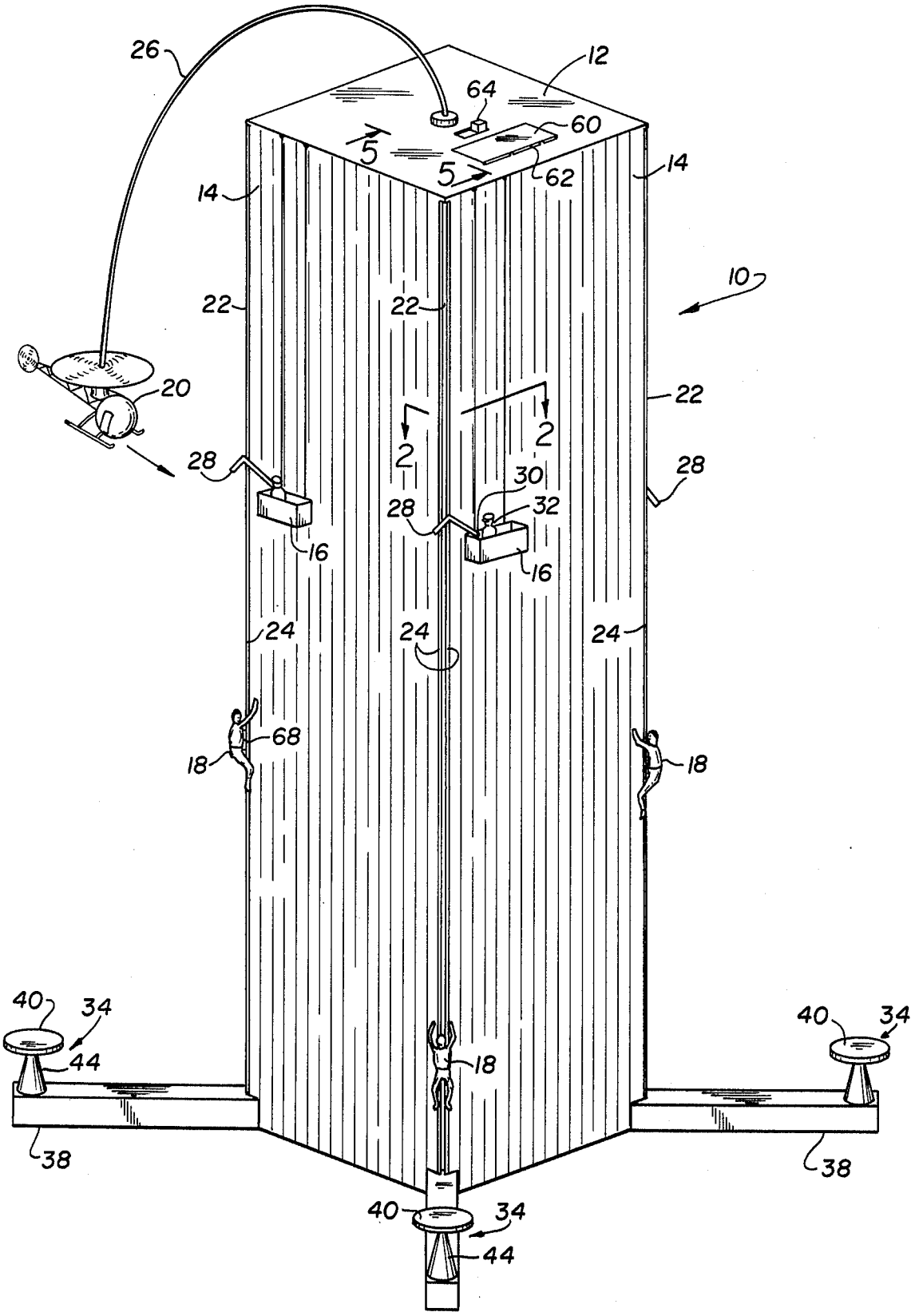
FIG. 1 is a perspective elevational view of the game apparatus embodying the features of the invention.

Referring to the drawings there is shown a simulated building structure 10, desirably having the configuration of a skyscraper such as one of the towers of the World Trade Center of New York City. The structure may be fabricated of a synthetic resin such as polyethylene or polypropylene and, as will be understood by persons in the art of game apparatus manufacture, may be formed by any of the well known molding techniques. The structure is formed with side walls 14 and with a roof 12. Preferably there are four side walls. On two or more of the side walls, and desirably on each of same, there is provided a scaffold 16. The function of such scaffolds will be described in detail hereinafter. A series of playing pieces 18 configured in the representation of a human are provided, such pieces being mountable on the corners of the structure 1 to be movable vertically therealong as will become clear. A helicopter 20 is rotatably mounted on the roof 12 of the structure 1 by means of a sway rod 26.

Each of the playing pieces, as stated above, is in the form of a human being and is mountable on a corner of the structure. Each of such corners is formed with a vertically extending slot or recess 22. Such recesses have longitudinally extending edge portions 24 which are desirably resilient so as to be cooperable with a section of the playing piece to retain the playing piece on the structure 1 at an elevation determined by operation of an actuating member 34. In the preferred form of the invention each playing piece is formed with an integral projection 68 configured and dimensioned such that it is insertable into a recess 22 and slightly deforms the edge portion 24 thereof to create a gripping force which serve to retain the playing piece in its elevational position.

The scaffolds 16, as stated above, are formed on each of the side walls of the structure in the preferred embodiment of the invention. It is contemplated that the structure will have four side walls and that each of such side walls will constitute one of the playing surfaces of the game as will be described in greater detail. Each scaffold may be formed integrally with the building structure or they may be separately formed and secured to the side wall. A hook element 28 is provided on each of the scaffolds and is pivotably mounted on a pivot pin 30 such that the hook element may be swung across the corner of the building into the upward path of the playing piece 18 as it ascends the structure. As depicted the hook element is pivotable through a horizontal arc; however, it will be understood that the hook element may be mounted for pivotal movement in a generally vertical plane. A figure 32 representative of a policeman is desirably positioned within the scaffold to impart the impression that he is manipulating the hook element so as to arrest the progress of the playing piece along the corner of the structure.

In order that an impact force be imparted to the playing piece to cause same to move incrementally upwardly during progress of the game there are provided one or more punch pads 34. The punch pads are manipulated in conjunction with a ball element 36 of sufficient size and weight to transmit a moving force to the playing piece upon actuation of the punch pad in the manner to be described. The punch pad includes a base 38 one end of which terminates in a housing 44 which may be tubular or conical and which is dimensioned to slidably accomodate a rod or shaft 42 surmounted by pad 40. Within the base, which may include side and top walls, there is mounted a lever element 48 balanced upon a fulcrum 50. Shaft 42 is preferably an extension of lever 48 and is given a central recess to permit the positioning of one end of a spring member 46 therewithin. The other end of such spring is biased against the base 38 so as to normally urge the shaft and its pad 34 upwardly. The end of the lever element 48 remote from the shaft 42 is given a vertical arm 52. The ball element 36 reposes within the corner recess of the structure 1 such that it normally rests upon the upper end of arm 52. However, in the operation of the game when the pad 34 is struck by a player the lever 48 is caused to pivot about its fulcrum and to propel the ball element upwardly through engagement with the upper extremity of arm 52. The ball element moves upwardly within the recess 22 and strikes the projection 68 on the playing piece to cause same to move upwardly to a higher elevation. The resilient nature of the edges 24 permit limited upward movement of the playing piece within the recess and then grip the playing piece so as to retain the piece in the new elevational position.

Referring to FIGS. 1 and 5 there is shown a motor bracket 54 carried by the roof of the structure. A motor 56 is supported by such bracket and drives the sway rod 26 for the helicopter so that the helicopter rotates about the exterior of the structure 1. If desired a reduction gear box 66 may be provided. A battery 58 is desirably supported from the roof within the structure for powering the motor. An off-on switch is operatively connected between the battery and motor in known fashion. In order to provide access to the interior of the structure for replacement of the battery and/or motor the roof is formed with a section which is either removable or pivotable. As depicted such section 60 is connected pivotably to the remainder of the roof by means of a hinge 62.

The game may be played generally as follows although it will be understood that the precise rules of the game may be varied to conform with the desires and dictates of the players.

Each player in the game is entitled to one playing piece 18 which is positioned at the lower corner of the structure atop a ball element. A punch pad 34 is placed at the base of the corner beneath the piece 18 such that it may be manipulated to propel the ball element 36 and thereby the piece 18 upwardly. The hook element 28 on the next adjacent side wall is swung away from the corner of the structure to permit the piece 18 on its adjacent corner to move upwardly unimpeded. It will be understood that each player manipulates a playing piece on the side wall of the structure in front of him and controls the scaffold located on the next adjacent side wall, i.e. clockwise thereof so as to be able to swing its hook element across the path of the playing piece of the opponent on such next side wall and corner thereof. If four players are participating in the game then, of course, four pieces will be utilized on the four corners of the structure and four scaffolds will be used. The first player to take a turn will manipulate the punch pad to elevate the playing piece upwardly as far as possible. The next player then takes a turn and attempts to elevate the piece 18 as far upwardly as is possible through manipulation of the punch pad. The players continue taking turns sequentially until one of the pieces reaches an elevational position within range of the scaffold hook element of the preceding player. At such time the preceding player, in turn, has the option of swinging the hook element across the path of the next player's piece or of manipulating his own punch pad to further elevate his own piece. When a player's piece is obstructed by another player's hook element the turn must be passed. However, it is possible for such player to operate his own hook element in order to obstruct the progress of the piece of the player next in line in the game. The object of the game is to propel the playing piece upwardly until it reaches the roof. Points may be assigned for the order of finish if desired.

It will be understood, of course, that the various elements of the game are preferably fabricated of a synthetic plastics material and in attractive colors so as to enhance enjoyment of the game. However, the specific materials from which the components of the game are made are not critical and, for example, it is contemplated that a relatively heavy grade card board may be employed.

Although the invention has been described in specific terms it will be understood that various changes may be made in size, shape, materials and in the arrangement of the components without departing from the spirit and scope of the invention as claimed.

Having thus set forth the nature of the invention, what is claimed herein is:

1. Superfly game apparatus comprising in combination:

a simulated building structure having side walls and a roof;

a scaffold carried by each of said side walls having means thereon pivotable to a location approximate the adjacent corner of the structure;

a simulated helicopter mounted on said roof for rotation about the structure;

a series of playing pieces each configured in the representation of a human figure and positionable on the respective corners of the structure for movement therealong;

retaining means on said structure cooperable with said playing pieces for retaining said pieces at different elevational levels;

and manually operable means for propelling said playing pieces vertically along the corners of said structure.

2. Game apparatus according to claim 1, wherein said playing piece retaining means comprise a vertically extending recess in each corner of said structure.

3. Game apparatus according to claim 2, wherein each of said recesses are provided with edge portions which are resilient and deformable by said pieces so as to permit limited vertical movement of the playing piece upon actuation of said playing piece propelling means.

4. Game apparatus according to claim 3, wherein each of said playing pieces is provided with a projection insertable into a recess of said structure and cooperable with with the edge portion of the corner recess so as to enable positioning of the playing piece in various elevational positions.

5. Game apparatus according to claim 2, wherein said playing piece propelling means comprises at least one punch pad positionable at the lower extremity of the corners of the structure and an associated ball element, each said punch pad including a lever operable upon being struck at one end thereof to impart upward movement to the associated ball element, said ball element being positionable within one of said recesses and movable therewithin to engage the playing piece mounted on the respective corner to thereby impart vertical upward movement thereto.

6. Game apparatus according to claim 5, including a punch pad for each corner of said structure.

7. Game apparatus according to claim 1, wherein said means on the scaffolds comprises a hook element pivotable across the upward path of the playing piece on the adjacent corner of the structure.

8. Game apparatus according to claim 1, wherein said roof is provided with a pivotable section providing access to the interior of the structure, motor means being mounted within the accessible region of the structure interior for effective rotation of said simulated helicopter, and battery means being mounted within said accessible region for powering said motor means.

9. Game apparatus according to claim 1, wherein each corner of said structure is provided at the lower extremity thereof with a notched portion to permit the positioning of one end of the playing piece propelling means therein.

10. Game apparatus according to claim 1, wherein one playing piece is provided for each corner of said structure.

* * * * *